US007049565B2

(12) United States Patent
Saluja et al.

(10) Patent No.: US 7,049,565 B2
(45) Date of Patent: May 23, 2006

(54) INDUCTIVE HEATING OF SEMI-SOLID MATERIAL

(76) Inventors: Navtej Singh Saluja, 39 Chilton St. Floor 2, Cambridge, MA (US) 02138-6801; Alfredo Riviere, Calle el Lindero, Quinta Aurat, Cerro Verde, Caracas 20 (VE)

( * ) Notice: Subject to any disclaimer, the term of this patent is extended or adjusted under 35 U.S.C. 154(b) by 0 days.

(21) Appl. No.: 10/377,393

(22) Filed: Feb. 28, 2003

(65) Prior Publication Data

US 2003/0213798 A1 Nov. 20, 2003

Related U.S. Application Data

(60) Provisional application No. 60/361,209, filed on Mar. 1, 2002.

(51) Int. Cl.
*H05B 6/02* (2006.01)

(52) U.S. Cl. ..... 219/661; 219/653

(58) Field of Classification Search ..... 219/661, 219/651, 647, 635, 602, 646; 164/476, 348, 164/338.1, 339, 4.1; 266/234, 237; 72/361, 72/364; 373/4, 7

See application file for complete search history.

(56) References Cited

U.S. PATENT DOCUMENTS

| | | | | |
|---|---|---|---|---|
| 3,431,382 A | | 3/1969 | Esche et al. | |
| 4,289,946 A | * | 9/1981 | Yarwood et al. | 164/503 |
| 4,524,820 A | * | 6/1985 | Gullotti et al. | 164/476 |
| 6,079,477 A | | 6/2000 | Woodhouse | |

FOREIGN PATENT DOCUMENTS

| | | |
|---|---|---|
| DE | 3820583 | 12/1989 |
| WO | WO 200127341 A1 * | 4/2001 |

* cited by examiner

*Primary Examiner*—Quang Van
(74) *Attorney, Agent, or Firm*—Choate,Hall & Stewart LLP

(57) ABSTRACT

The present invention utilizes a dynamically controlled frequency system for the process of induction heating semi-solid material. Semi-solid precursor material is machined into billets of a desired size. These billets are subjected to one or more heating processes utilizing an induction heating process that is dynamically controlled by adjusting the frequency of an induction coil current to achieve a desired temperature in a semi-solid material billet.

9 Claims, 1 Drawing Sheet

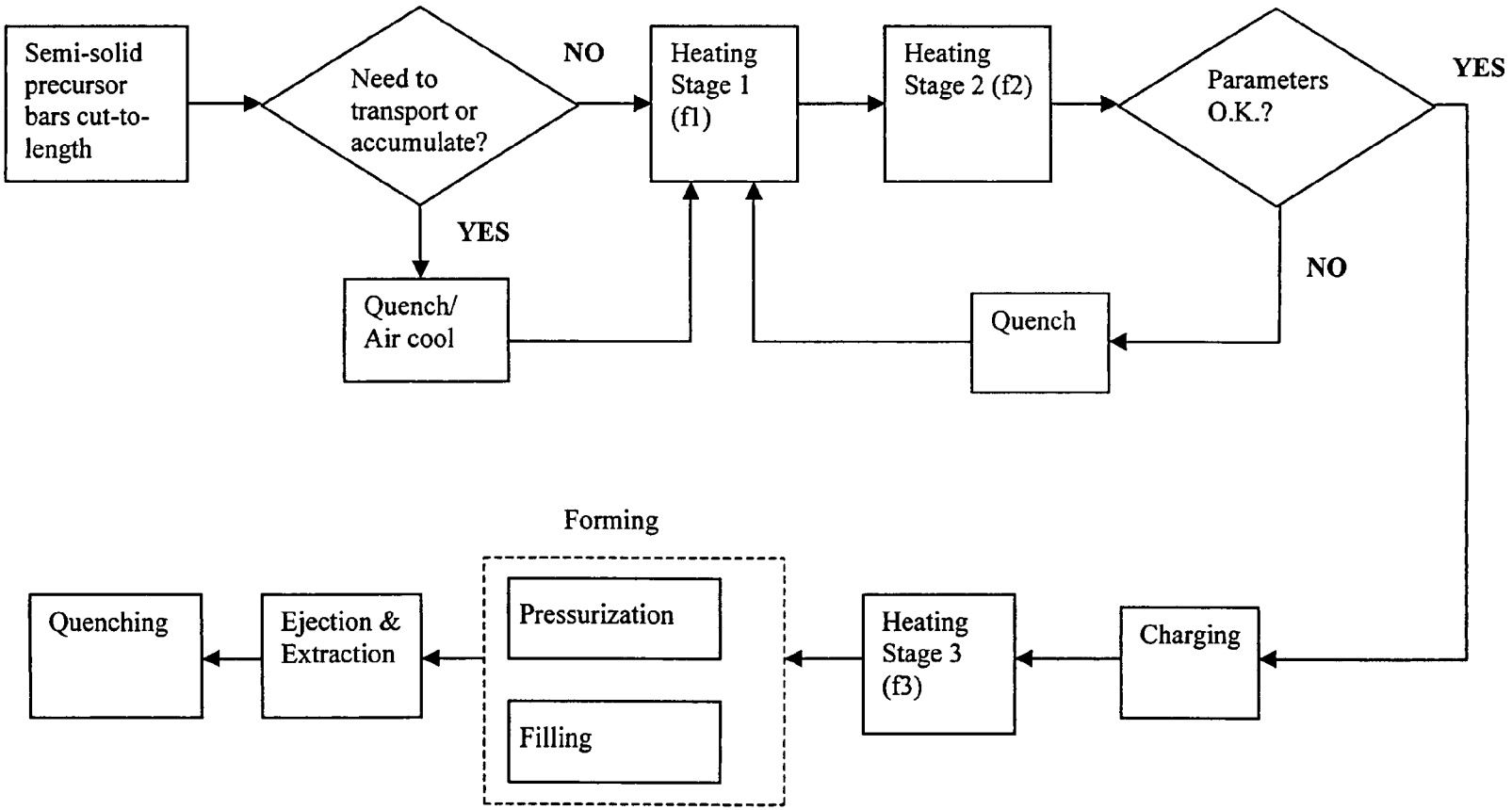
THE FIGURE

INDUCTIVE HEATING OF SEMI-SOLID MATERIAL

CROSS-REFERENCE TO RELATED APPLICATIONS

The present application claims priority to U.S. Provisional Application Ser. No. 60/361,209, filed Mar. 1, 2002, the teachings of which are incorporated herein by reference.

FIELD OF THE INVENTION

The present invention relates to the field of inductive heating of semi-solid material.

BACKGROUND OF THE INVENTION

Induction heating of material involves the use of a generated magnetic field to induce a current flow in a material and a corresponding heating (termed $I^2R$ heating). Current techniques require the equipment for this process to be pre-set with dimensions of a particular batch of billets or bars to be heated. Individual billets not exactly matching these dimension settings could be heated inaccurately. Billets once heated above the solidus cannot be recycled and must be thrown away. This process can result in a large percentage of wasted billets, reaching as high as 20–30% of a batch wasted.

There is thus a need for a method and apparatus for reducing the inefficiencies and waste in an induction heating process.

SUMMARY OF THE INVENTION

The present invention utilizes a dynamically controlled frequency system for the process of induction heating semi-solid material. Semi-solid precursor material is machined into billets of a desired size. These billets are subjected to one or more heating processes utilizing an induction heating process that is dynamically controlled by adjusting the frequency of an induction coil current to achieve a desired temperature in a semi-solid material billet.

BRIEF DESCRIPTION OF THE DRAWING

The present invention is described with reference to the several figures of the drawing, in which:

The FIGURE is a block diagram of a method according to one embodiment of the invention.

DETAILED DESCRIPTION OF THE INVENTION

In the induction heating of material, the desired frequency of the coil current is determined by the diameter of the billet and the mass of the billet. This frequency determines the penetration depth of the induced current, namely how far into the billet the induced current is generated. The penetration depth (PD) is inversely proportional to the square root of the frequency; as frequency increases, penetration depth decreases. Current techniques for induction heating generally are performed using a coil current frequency of 700 Hz. Table 1 lists example frequencies used for billets having the indicated diameters heated according to the present invention.

TABLE 1

| Billet diameter (inches) | Frequency (Hz) |
|---|---|
| 3 | 50 |
| 5 | 25 |
| 7 | 15 |

The frequency is regulated by means of a variable speed drive (VSD). The inductive heating can be carried out either in an adaptive manner with feedback control (continuously varying frequency) or by step-changes in frequency resulting in a multi-stage heating process. The cylindrical geometry of a billet means that the penetration of the induced current occurs on all sides of the billet. The dynamic control of individual induction coils allows changes in frequency not only between individual billets, but also during the inductive heating of a single billet.

Referring now to the figures of the drawing, the figures constitute a part of this specification and illustrate exemplary embodiments of the invention. It is to be understood that in some instances various aspects of the invention may be shown exaggerated or enlarged to facilitate an understanding of the invention.

The FIGURE is a block diagram of a method according to one embodiment of the invention. Semi-solid precursor material bars are cut-to-length into billets or slugs. The billets are subjected to multiple induction heating stages. The initial external heating stages are at temperatures suitably below the solidus temperature of the material such that certain parameters of the material can be evaluated for material suitability for semi-solid forming before continuing the process. At these stages, if the decision logic indicates that parameters of a particular billet are not suitable for the semi-solid forming process, the billet can be quenched and reheated thereby allowing material recycling and waste reduction. If the parameters are satisfied, the billet then enters the charging process which involves delivering the billet to a tunnel induction furnace for heating to a temperature between the solidus and liquidus of the material.

The heating process can potentially be split into two stages: "external" and "internal". External heating is performed outside of the forming machine. Internal heating occurs inside the forming machine. The final heating stage can potentially be a combination of both internal and external heating.

Heating is relatively insensitive to length of semi-solid precursor billet, thus avoiding a situation where minor length variations can cause non-reproducible heating conditions. Also, when the length of the billet is changed (in order to form a product of different weight), the heating characteristics do not have to be readjusted (a very cumbersome process).

The final stages of semi-solid forming involve delivering the heated semi-solid precursor billet to semi-solid forming means, pressurizing the material so that it is ejected, then extracting and quenching the resulting product.

In one embodiment, the heating of the billets takes place in individually controlled trays. A billet is inserted horizontally into an enclosed tray. A load sensor determines the length and weight of the billet and configures the frequency of the induction coil according to a desired temperature setting. For example, the temperature setting could be a surface temperature anywhere in the range of 400° C. to 600° C. Multiple billets are heated in staggered degrees to produce a continuous production flow. For example, for five trays, heating time could be five minutes which each tray having a heating time offset of 1 minute. The resulting production flow rate is 1 billet per minute. Billets could potentially be heated vertically, however, this often results in the so-called "elephant foot" problem wherein the base of the billet because larger due to material flow during the heating process.

In one example, the power unit to supply the induction current is 1000 kW having a rating of P.F. 0.9. The unit receives standard 3 phase 60 Hz current and transforms the current to a desired coil current level (see Table 1). In general, a surface energy density of 357 $kW/m^2$ is supplied to induction heat the surface temperature of a billet from a 25° C. to 595° C.

The invention further comprises the following:

Induction means where frequency of coil current (as a function of heating time) is chosen to minimize total heating time, but still get the right microstructure by strain-relief (a mass diffusion process).

A means whereby the heated billet is found not to meet certain criteria can be quenched and recycled before being further heated, externally or internally.

An internal heating means whereby the final heat to the billet can be provided inside the forming machine or inside a part/container/cavity which can be considered an integral part of the forming machine.

A means whereby the internal heating can be done without contact with the ambient.

A means whereby the external heating can be done without contact with the ambient.

A means whereby the internal heating can be done in an inert, moisture-free environment or in a vacuum.

A means whereby the external heating can be done in an inert, moisture-free environment or in a vacuum.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. An apparatus for inductive heating of semi-solid material, comprising:

an inductive heating coil;

a dynamic frequency controller to dynamically control a frequency that changes a coil current of said inductive heating coil, wherein said controller dynamically controls said frequency based on at least one parameter of a semi-solid material; and a decision logic system that monitors said frequency and said at least one parameter of said semi-solid material and determines whether at least one selected frequency is suitable for the at least one parameter of said semi-solid material, wherein said at least parameter includes at least one characteristic of a billet of said semi-solid material.

2. The apparatus of claim 1, wherein said semi-solid material is initially inductively heated to a temperature that does not exceed a solidus temperature of said semi-solid material and, after said at least one selected frequency is determined as suitable by said decision logic system, said semi-solid material is inductively heated to a temperature between said solidus temperature and a liquidus temperature of said semi-solid material.

3. The apparatus of claim 1, wherein said at least one characteristic of the billet includes at least one of a billet diameter, a billet length and a billet weight.

4. The apparatus of claim 1, wherein said dynamic frequency controller is a variable speed drive.

5. A method for inductive heating of semi-solid material, comprising:

providing a semi-solid material;

dynamically controlling a frequency of an induction coil current to heat said semi-solid material, wherein said frequency is dynamically controlled based on at least one parameter of said semi-solid material; and monitoring said frequency and said at least one parameter of said semi-solid material and determining whether at least one selected frequency is suitable for the at least one parameter of said semi-solid material, wherein said at least one parameter includes at least one characteristic of a billet of said semi-solid material.

6. The method of claim 5, wherein said semi-solid material is initially inductively heated to a temperature that does not exceed a solidus temperature of said semi-solid material and, after said at least one selected frequency is determined as suitable, said semi-solid material is inductively heated to a temperature between said solidus temperature and a liquidus temperature of said semi-solid material.

7. The method of claim 5, wherein said at least one characteristic of the billet includes at least one of a billet diameter, a billet length and a billet weight.

8. The method of claim 5, wherein said dynamic control of frequency is performed with continuous feedback control.

9. The method of claim 5, wherein said dynamic control of frequency is performed by step-changes in frequency.

* * * * *